US012677951B1

(12) United States Patent
Zhang

(10) Patent No.: US 12,677,951 B1
(45) Date of Patent: Jul. 14, 2026

(54) FOLDABLE ROCKING CHAIR FRAME AND ROCKING CHAIR

(71) Applicant: Ninghai Jiarun Hardware Co., Ltd., Ningbo (CN)

(72) Inventor: Zhenguo Zhang, Ningbo (CN)

(73) Assignee: Ninghai Jiarun Hardware Co., Ltd., Ningbo (CN)

( * ) Notice: Subject to any disclaimer, the term of this patent is extended or adjusted under 35 U.S.C. 154(b) by 0 days.

(21) Appl. No.: 19/455,891

(22) Filed: Jan. 22, 2026

(30) Foreign Application Priority Data

Dec. 25, 2025 (CN) ..... 202522748926.5

(51) Int. Cl.

| | |
|---|---|
| ***A47C 4/44*** | (2006.01) |
| ***A47C 3/025*** | (2006.01) |
| *A47C 3/027* | (2006.01) |
| *A47C 4/22* | (2006.01) |
| *A47C 4/46* | (2006.01) |

(52) U.S. Cl.
CPC ..... *A47C 4/44* (2013.01); *A47C 3/0255* (2013.01); *A47C 3/027* (2013.01); *A47C 4/22* (2013.01); *A47C 4/46* (2013.01)

(58) Field of Classification Search
CPC .. A47C 4/04; A47C 4/028; A47C 4/46; A47C 4/48; A47C 4/50; A47C 4/20; A47C 4/22; A47C 4/24; A47C 4/26; A47C 4/10; A47C 4/12; A47C 4/14; A47C 4/16; A47C 3/027
See application file for complete search history.

(56) References Cited

U.S. PATENT DOCUMENTS

| | | | | |
|---|---|---|---|---|
| 4,853,990 A * | 8/1989 | Elder | A47C 20/041 5/634 |
| 5,567,009 A * | 10/1996 | Fay | A47C 3/027 297/271.1 |
| 12,433,406 B2 * | 10/2025 | Sun | A47C 4/021 |
| 2025/0031853 A1 * | 1/2025 | Zhang | A47C 4/30 |

* cited by examiner

*Primary Examiner* — Syed A Islam

(57) ABSTRACT

A rocking chair includes: two upper bases and two lower bases arranged vertically and hinged to each other to form two groups of hinged assemblies spaced apart from each other on left and right; an upper connecting rod, two ends of the upper connecting rod are respectively connected to the two upper bases; and a lower connecting rod, two ends of the lower connecting rod are respectively connected to the two lower bases; and a plurality of first springs disposed between the upper base and the lower base of each group. The first springs are arranged in a front-rear staggered manner relative to a hinged position of the upper base and the lower base. Each upper base is connected to one end of a supporting rod, and another end of the supporting rod is configured to be connected to chair cloth. Each lower base is connected to one supporting leg.

7 Claims, 21 Drawing Sheets

B - B

FOLDABLE ROCKING CHAIR FRAME AND ROCKING CHAIR

CROSS REFERENCE TO RELATED APPLICATIONS

The present application which claims the benefit of Chinese Patent Application No. 202522748926.5 filed on Dec. 25, 2025, the contents of which are incorporated herein by reference in their entirety.

TECHNICAL FIELD

The present disclosure relates to the technical field of rocking chairs, and more specifically relates to a foldable rocking chair frame and a rocking chair.

BACKGROUND

Outdoor foldable chairs are widely used due to their lightweight structure and convenient storage. To improve the enjoyment and comfort of outdoor use, a rocking chair function is added to an existing foldable chair based on a conventional supporting frame. General structural forms roughly include two types: in one type, chair cloth is hung on a chair frame, so that a chair body can swing back and forth at a fulcrum in a manner similar to a swing; and in the other type, a structure capable of reclining or rocking can be added into a chair frame body, so that the entire chair frame generates a rocking effect relative to the ground. These solutions generally rely on the hinging of a bracket to achieve the rocking function.

For example, the existing technology discloses a detachable compression spring rocking chair. A mounting bracket and a connection plate sleeve are in left-right staggered arrangement. In this structure, a down force generated in a load-bearing process of the rocking chair is mainly transferred through a plug-in rod between the mounting bracket and the connection plate sleeve, so that the plug-in rod bears a relatively high vertical shearing force, and long-time use of the plug-in rod easily causes stress concentration and structural fatigue.

In addition, in the solution of the detachable compression spring rocking chair, connection plate sleeves on left and right sides have a tendency of being staggered from each other when bearing a load, so that it is difficult to synchronize twisting actions of the two connection plate sleeves around the plug-in rod. Consequently, this affects the stability of overall rocking and the user experience.

SUMMARY

The present disclosure aims to at least solve one of the technical problems in the related art to an extent. To this end, an embodiment of the present disclosure provides a foldable rocking chair frame which implements vertical transferring of a load-bearing force through bases arranged vertically and uses paired connecting rods and the upper and lower bases to jointly form a dynamic parallelogram mechanism, thereby significantly improving load-bearing performance and structural stability of the chair frame.

An embodiment of the present disclosure further provides a foldable rocking chair having the above chair frame.

A technical solution used in the present disclosure is as follows: A foldable rocking chair frame includes two groups of upper bases and lower bases that are spaced apart from each other on left and right. The upper base and the lower base of each group are arranged vertically and are connected through a hinge, thus forming a basic hinged assembly for rocking. The two upper bases are connected to each other through an upper connecting rod, and the two lower bases are connected to each other through a lower connecting rod, so as to form an overall stable frame structure in a left-right direction.

A plurality of first springs are disposed between the upper base and the lower base of each group, and the first springs are arranged in a front-rear staggered manner relative to a hinged position, to provide a resetting force and a damping characteristic during rocking, thereby helping improve the comfortable experience of the rocking chair. Each upper base is connected to one end of a supporting rod, and another end of the supporting rod is configured to mount chair cloth, thus forming a bearing portion of the rocking chair. Each lower base is connected to one supporting leg, so that the chair frame can be stably supported on the ground.

In the present disclosure, through the vertical arrangement of the upper bases and the lower bases, a load-bearing path of a seat is mainly in a vertical direction, and a load of the upper bases can be directly transferred downwards to the lower bases, thereby avoiding a lateral shearing force that easily occurs in a conventional structure, and significantly improving overall load-bearing capability and structural reliability. Based on this, the upper connecting rod and the lower connecting rod that are paired are provided, and the upper connecting rod synchronously moves with the upper bases, so that the upper and lower connecting rods and the upper and lower bases jointly form a dynamically variable parallelogram mechanism. The dynamic structure provides a stable geometrical constraint in a process of rocking, rising, falling, or angle changing of the rocking chair, so that left and right structures always remain synchronous, and force transferring is more uniform, thereby effectively avoiding problems such as misplaced rocking, shaking, and local stress concentration that are common in the existing technology, and improving stability of a rocking process and overall use comfort.

In addition, in the present disclosure, the first springs are arranged in the front-rear staggered manner relative to a hinged position, so that the first springs can provide more natural and smoother mechanical feedback during starting, reciprocation, and resetting of the rocking chair. The supporting rods and the supporting legs that are connected to the chair cloth also achieve reliable hinging by means of proper base arrangement, so that folding and unfolding processes are simple, convenient, and smooth, and supporting after unfolding is ensured to be strong. In conclusion, the present disclosure entirely improves the structural stability, durability, and rocking user experience of the foldable rocking chair frame.

According to one embodiment of the present disclosure, upper connection slots are formed in opposite inner sides of the two upper bases, and the upper connecting rod is plugged into the upper connection slots. In this structure, the upper connecting rod is mounted more stably, and a transverse displacement of the upper connecting rod is effectively limited during use, thereby improving overall stability of the chair frame.

According to one embodiment of the present disclosure, upper fasteners are connected to the upper bases, and inner ends of the upper fasteners extend into the upper connection slots and abut against plugged portions of the upper connecting rod. The upper connecting rod is pressed and fixed through the fasteners, so that adjustment and assembling are facilitated, positioning reliability of the connecting rod is enhanced, and loosening during rocking is prevented.

According to one embodiment of the present disclosure, upper clearance slots are formed in lower ends of the upper bases, and head portions of the upper fasteners are disposed within the upper clearance slots. This structure avoids interference caused by the exposed head portions of the fasteners, improves appearance integrity, and reduces a hanging collision risk.

According to one embodiment of the present disclosure, lower connection slots are formed in opposite inner sides of the two lower bases, and the lower connecting rod is plugged into the lower connection slots. This structure makes the connection of the lower connecting rod more stable, which helps to improve overall force uniformity and durability of the chair frame.

According to one embodiment of the present disclosure, lower fasteners are connected to the lower bases, and inner ends of the lower fasteners extend into the lower connection slots and abut against plugged portions of the lower connecting rod. By compressing and fixing the connecting rod through the lower fasteners, a lower structure can be prevented from being loosened during rocking, thereby improving reliability of the rocking chair.

According to one embodiment of the present disclosure, lower clearance slots are formed in lower ends of the lower bases, and head portions of the lower fasteners are disposed within the lower clearance slots. The clearance structure can effectively protect the head portions of the lower fasteners, and avoid interference with another object during use or movement.

According to one embodiment of the present disclosure, each upper base is provided with an upper open slot, and the supporting rod is hinged to the upper open slot; and/or each lower base is provided with a lower open slot, and the supporting leg is hinged to the lower open slot. Through the open slots, a more flexible hinge arrangement is implemented, folding smoothness of the supporting rods and the supporting legs is improved, and a blocking phenomenon is mitigated.

According to one embodiment of the present disclosure, the foldable rocking chair frame further includes third springs disposed between the upper base and the lower base of each group; and the third springs and the first springs are respectively located on front and rear sides of the hinged position.

According to one embodiment of the present disclosure, each lower base is provided with a plugging slot; and when the supporting leg is rotated to an unfolding position, an inner end of the supporting leg is slidably plugged into the plugging slot to lock an angle. Through a mechanical plugging limiting structure, a stable angle of each supporting leg can be maintained after unfolding, thereby significantly improving reliability and safety of supporting of the chair frame.

BRIEF DESCRIPTION OF THE DRAWINGS

To describe the technical solutions in the embodiments of the present disclosure or in the prior art more clearly, the following briefly introduces the accompanying drawings for describing the embodiments or the related art. Apparently, the accompanying drawings in the following description show merely some embodiments of the present disclosure, and a person of ordinary skill in the art may still derive other drawings according to these accompanying drawings without creative efforts.

Numerals in the accompanying drawings.

Figure 1:
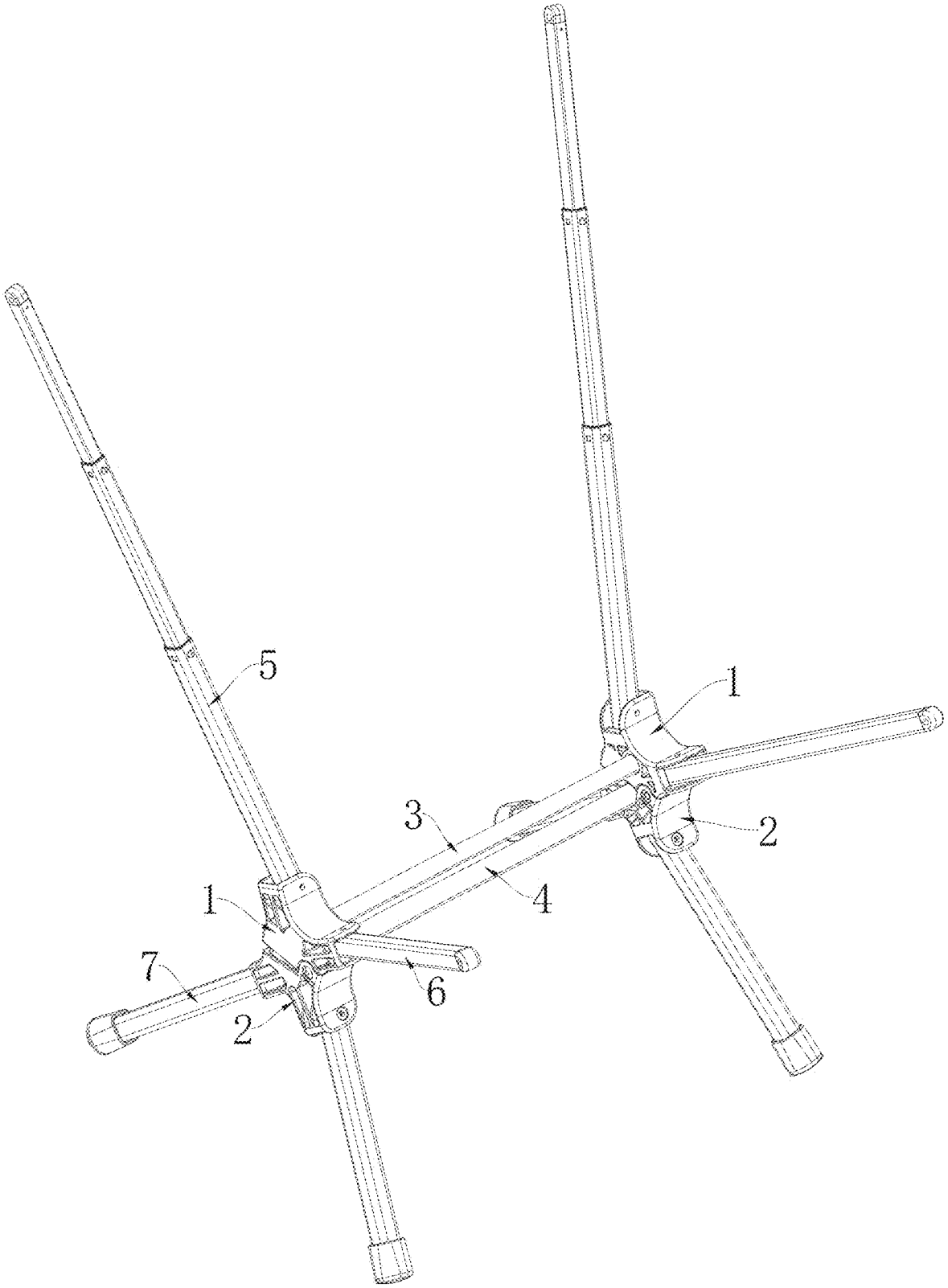
FIG. 1 is a perspective view of a rocking chair frame according to Embodiment I of the present disclosure.

1: upper base; 2: lower base; 3: upper connecting rod; 4: lower connecting rod; 5: chair back supporting rod; 6: chair seat supporting rod; 7: supporting leg; 8: first spring; 9: upper fastener; 10: lower fastener;

11: first shaft seat; 12: lip edge; 13: upper connection slot; 14: upper open slot; 15: upper mounting slot; 16: upper clearance slot; 17: upper clamping pillar; 18: front stop part; 19: rear stop part; 110: third spring;

21: second shaft seat; 22: boss; 23: lower connection slot; 24: lower open slot; 25: lower mounting slot; 26: lower clearance slot; 27: lower clamping pillar; 28: front blocking part; 29: rear blocking part;

21*a*: first shaft hole;

24*a*: second shaft hole; 24*b*: plugging slot;

71: rod body; 72: connector; 73: rotating shaft; 74: shaft sleeve; 75: second spring; 71*a*: first kidney-shaped hole;

72*a*: second kidney-shaped hole; and 72*b*: sliding chute.

DETAILED DESCRIPTION

The embodiments of the present disclosure are described in detail below, and examples of the embodiments are shown in accompanying drawings, where the same or similar elements or the elements having same or similar functions are denoted by the same or similar reference numerals throughout the description. The embodiments described below with reference to the accompanying drawings are exemplary and used only for explaining the present disclosure, and should not be construed as a limitation on the present disclosure.

Embodiment I

As shown in FIG. 1 to FIG. 19, a foldable rocking chair frame includes two groups of upper bases 1 and lower bases 2 that are spaced apart from each other on left and right. The upper base 1 and the lower base 2 of each group are arranged in an up-down direction, and are connected in a hinged manner, thus forming a basic rocking hinged assembly that can implement forward tilting and backward rocking. The two upper bases 1 are connected to each other through an upper connecting rod 3, and the two lower bases 2 are connected to each other through a lower connecting rod 4, so as to form a stable frame structure for the chair frame in a left-right direction and ensure that the structures on both sides remain synchronized during the rocking.

Figure 3:
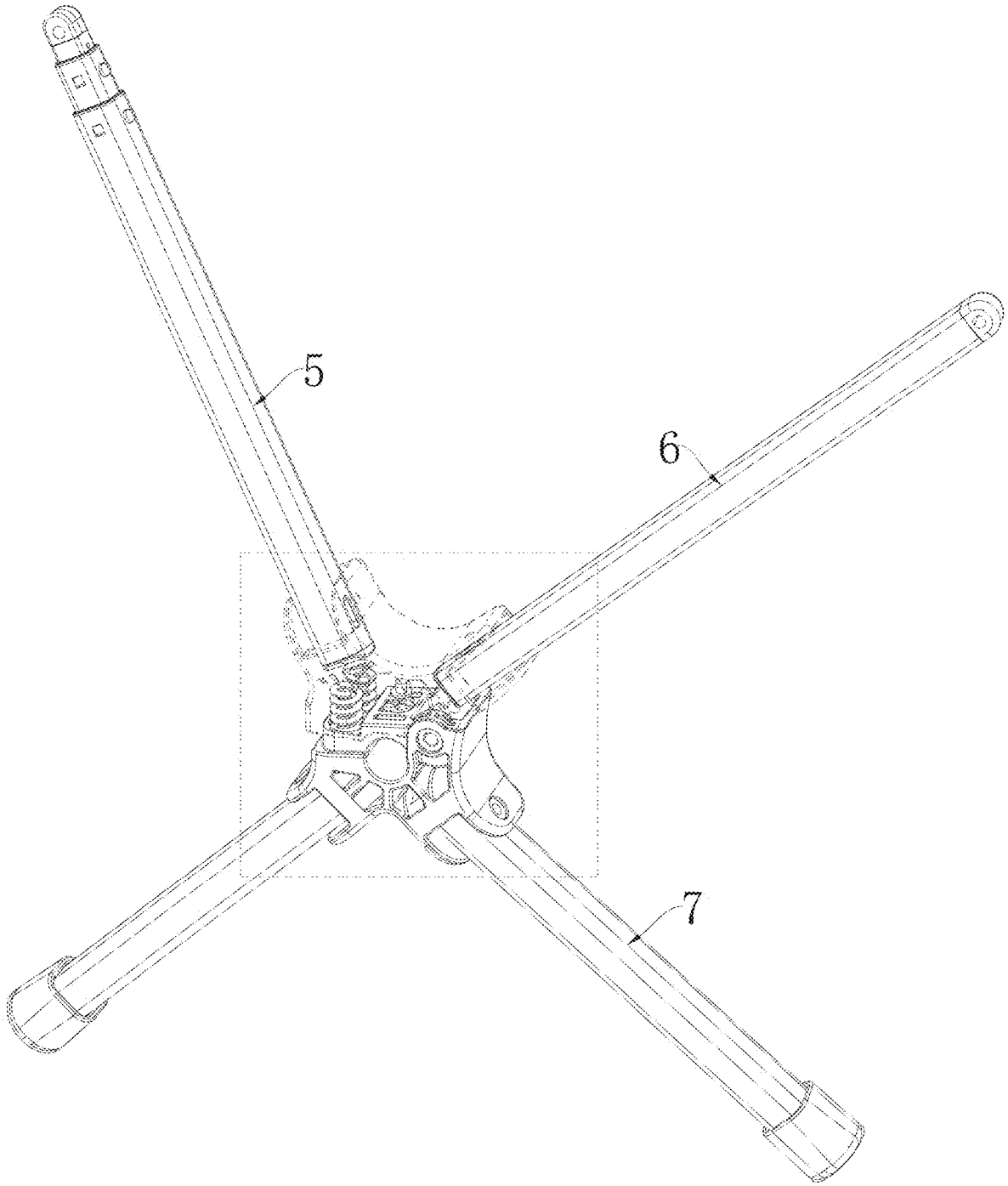
FIG. 3 is a perspective view of one side of a chair frame according to Embodiment I of the present disclosure.
Figure 4:
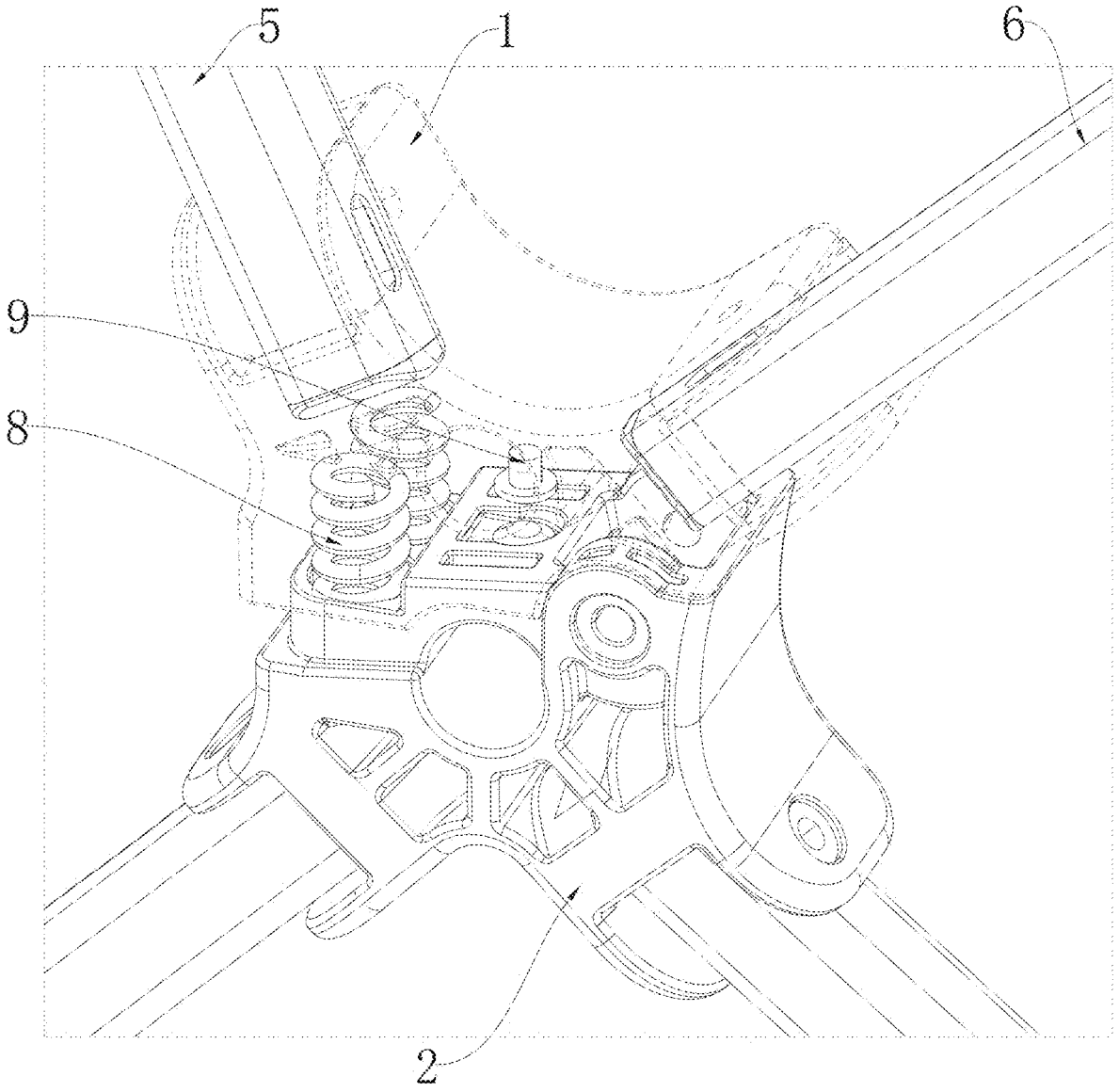
FIG. 4 is a partially enlarged view of the chair frame in FIG. 3.

Specifically, as shown in FIG. 3 and FIG. 4, a plurality of first springs 8 are disposed between the upper base 1 and the lower base 2 of each group. The first springs 8 are arranged in a front-rear staggered manner relative to a hinged position, so that the first springs 8 can provide a resetting force and a damping characteristic during starting, reciprocation, and resetting of the rocking chair, so that a rocking action is more natural and smoother. Each upper base 1 is connected to one end of a supporting rod, and another end of the supporting rod is configured to support chair cloth, so that the chair cloth forms a supporting surface capable of bearing a weight of a user. Each lower base 2 is connected to a supporting leg 7, to stably support the entire chair frame on the ground.

Figure 2:
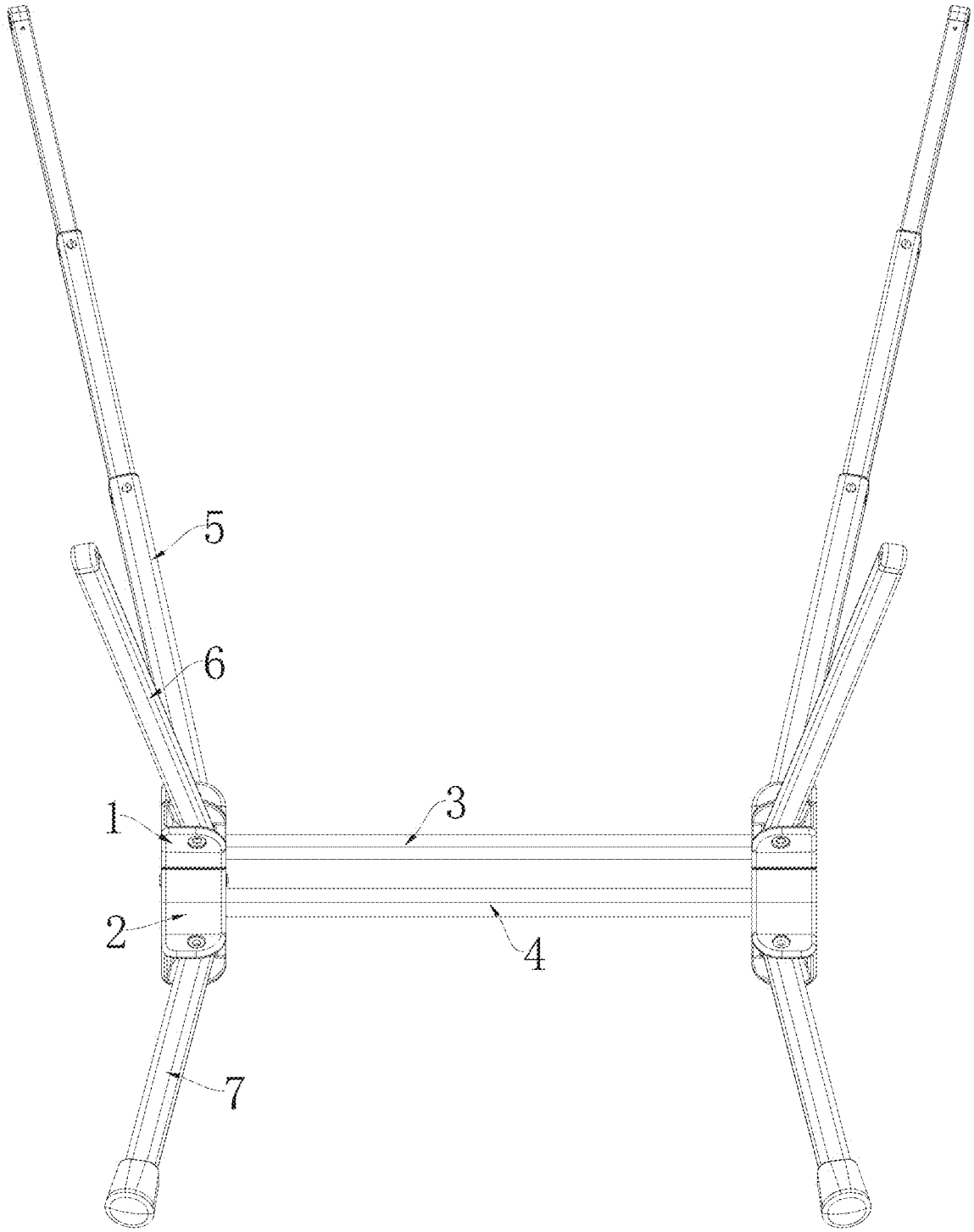
FIG. 2 is a front view of a rocking chair frame according to Embodiment I of the present disclosure.

Further, as shown in FIG. 1 and FIG. 2, the supporting rod includes a chair back supporting rod 5 and a chair seat supporting rod 6. Each upper base 1 is provided with two upper open slots 14 that are respectively located on a front side and a rear side. The upper open slot 14 on the front side is configured to be hinged to the chair seat supporting rod 6, and the upper open slot 14 on the rear side is configured to be hinged to the chair back supporting rod 5, so that a proper supporting structure can be obtained in a chair back region and a chair seat region. A length of the chair back supporting rod 5 is greater than a length of the chair seat supporting rod 6, so that a chair back portion has a greater back supporting height. The chair seat supporting rod 6 and the chair back supporting rod 5 both use telescoping structures, so that an unfolding angle, tightness, and a supporting height of the chair cloth can adapt to users of different body shapes.

Figure 5:
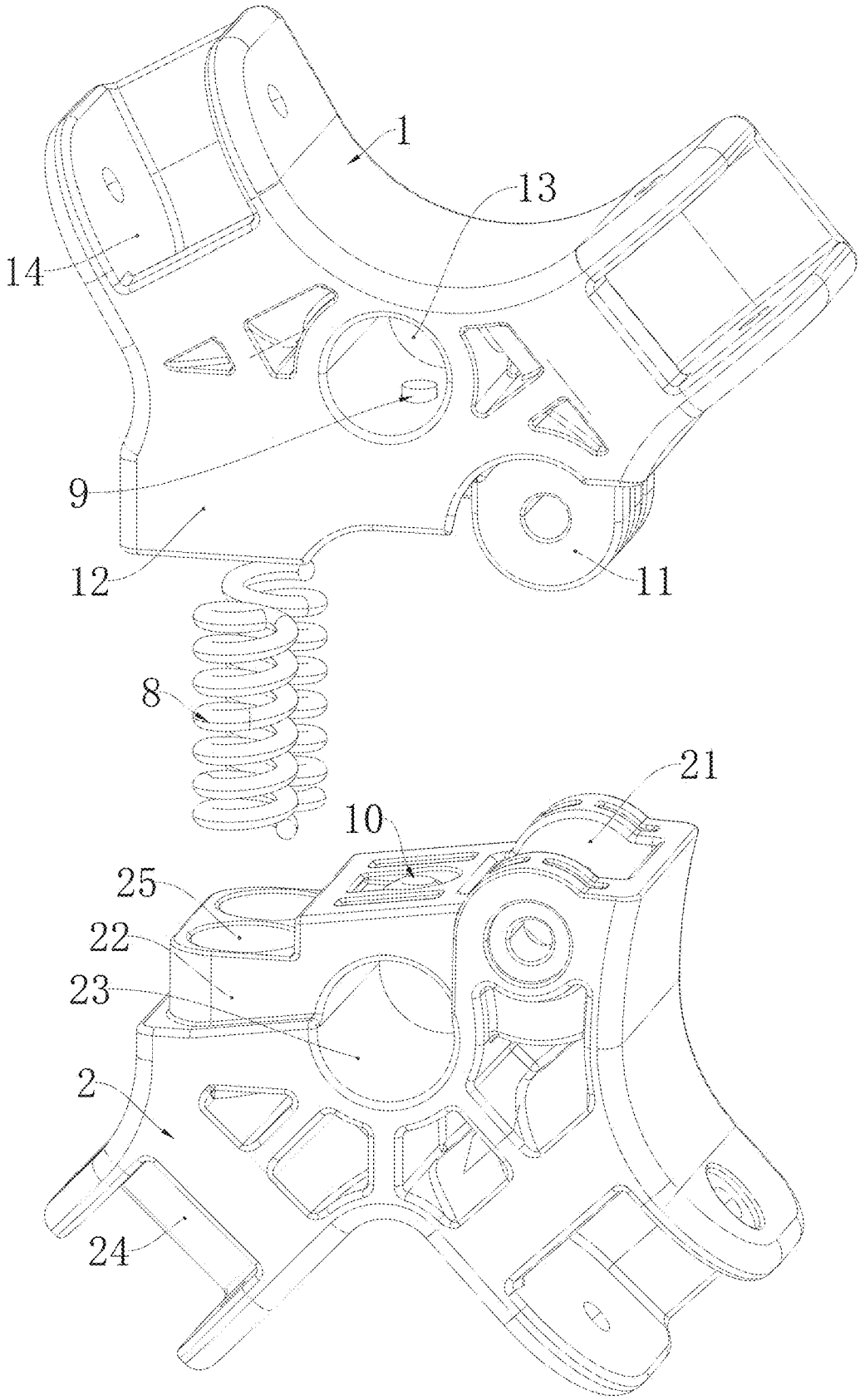
FIG. 5 is an explosive view of a chair frame according to Embodiment I of the present disclosure.
Figure 6:
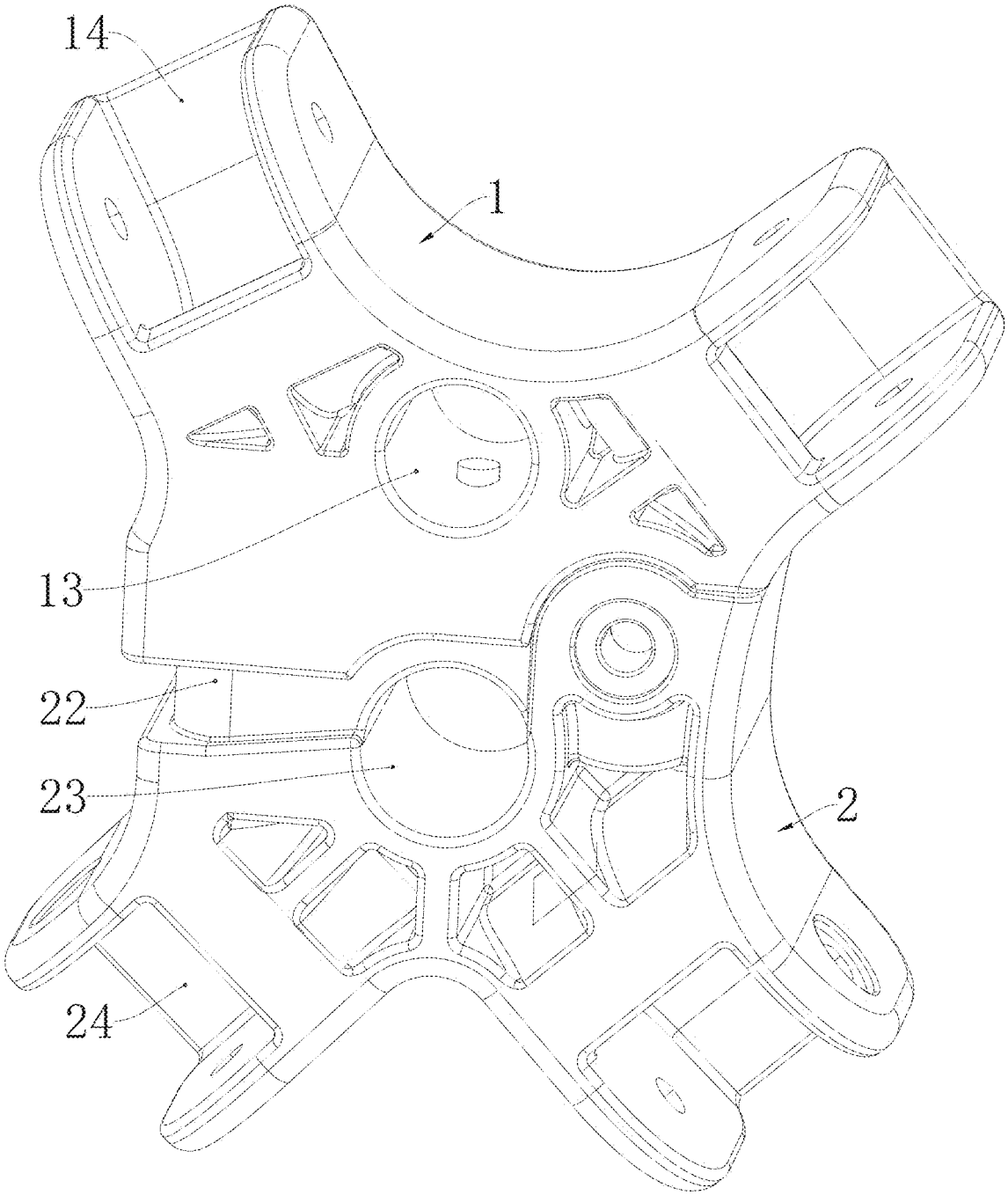
FIG. 6 is a perspective view of an upper base and a lower base according to Embodiment I of the present disclosure.

Further, as shown in FIG. 5 and FIG. 6, a first shaft seat 11 is arranged at a lower portion of each upper base 1. A second shaft seat 21 is arranged at an upper portion of each lower base 2. The first shaft seat 11 and the second shaft seat 21 are arranged in a left-right staggered manner, and are combined to form a first shaft hole 21*a*. The first shaft hole 21*a* is configured to receive a hinge shaft, so that the upper base 1 can perform forward tilting and backward rocking rotation around the hinge shaft relative to the lower base 2. A lip edge 12 is continuously formed at a lower edge of the upper base 1. A boss 22 is provided at an upper portion of the lower base 2. The lip edge 12 accommodates the boss 22 at its inner side, to achieve a shield and dustproof effect, thus preventing the first springs 8 from being exposed, so that fit between the upper base and the lower base 2 is more stable. Lower mounting slots 25 are formed in the boss 22. Lower clamping pillars 27 are disposed within the lower mounting slots 25. Lower ends of the first springs 8 are accommodated in the lower mounting slots 25 and are clamped and fixed through the lower clamping pillars 27. In addition, upper mounting slots 15 are formed in each upper base 1. Upper clamping pillars 17 are disposed within the upper mounting slots 15. Upper ends of the first springs 8 are accommodated in the upper mounting slots 15 and are clamped and fixed through the upper clamping pillars 17, thereby implementing reliable positioning of the first springs 8 between the upper base and the lower base 2.

Figure 11:
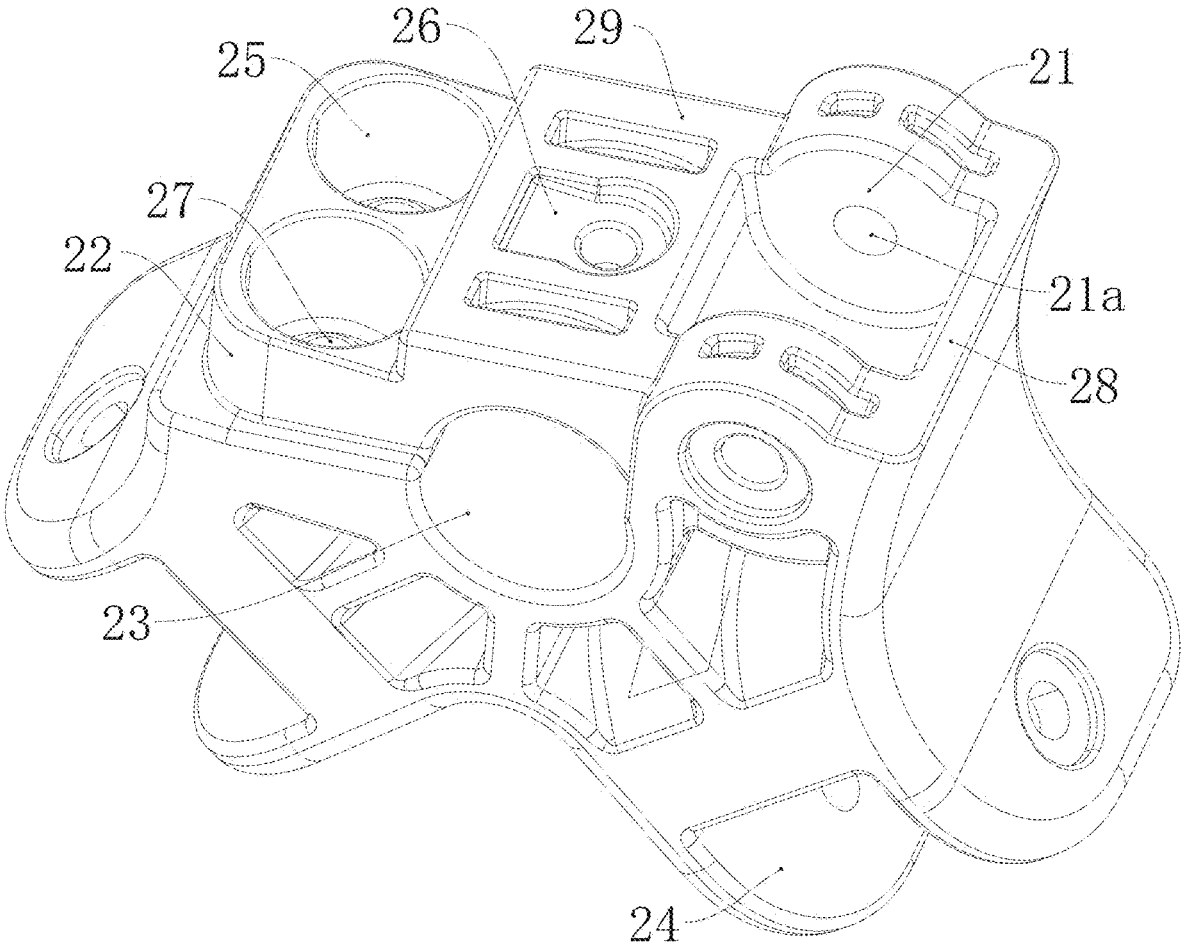
FIG. 11 is a structural perspective view of a lower base according to Embodiment I of the present disclosure.

Still further, as shown in FIG. 11, an edge of the second shaft seat 21 forms a front blocking part 28. One end of the first shaft seat 11 that faces the second shaft seat 21 has a rear stop part 19. Correspondingly, one end of the second shaft seat 21 that faces the first shaft seat 11 has a rear blocking part 29. In addition, an edge of the first shaft seat 11 forms a front stop part 18. When the chair frame rocks forward or backward, the front stop part 18 is abutted with the front blocking part 28 to implement forward limitation, and the rear stop part 19 is abutted with the rear blocking part 29 to implement backward limitation, so as to reliably limit a rocking travel and prevent structural instability or uncomfortable use caused by excessively large rocking amplitude.

Figure 12:
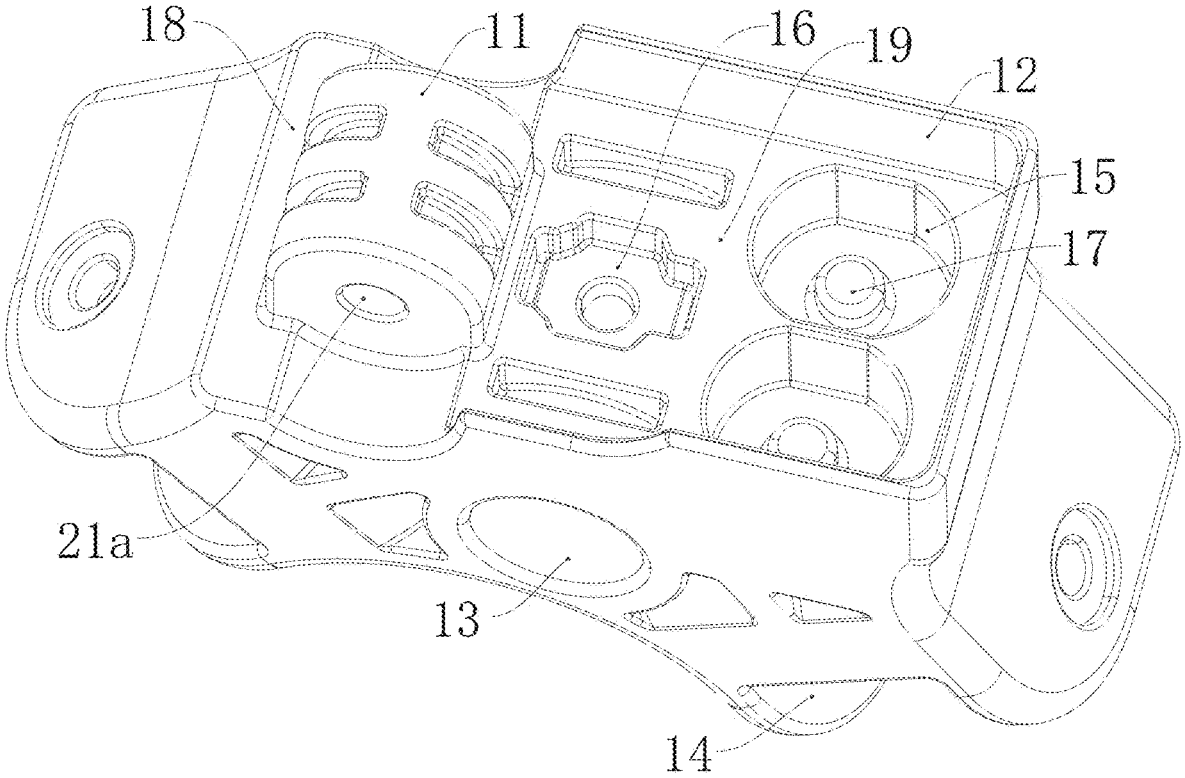
FIG. 12 is a structural perspective view of an upper base according to Embodiment I of the present disclosure.

Specifically, as shown in FIG. 12, upper connection slots 13 are oppositely formed in inner side surfaces of the two upper bases 1, and the upper connecting rod 3 is disposed within the upper connection slots 13 in a plugged manner. The structure can provide stable transverse connection between the left and right groups of upper bases 1, and effectively limit a transverse displacement of the upper connecting rod 3, so that the linkage between the left and right bases in the rocking process is more reliable. Upper fasteners 9 are mounted on the upper bases 1 in a connected manner, and inner ends of the upper fasteners 9 extend into the upper connection slots 13 and abut against plugged portions of the upper connecting rod 3. The upper connecting rod 3 can be compressed and fixed by using the upper fasteners 9, which is beneficial for mounting and adjustment, and can provide higher connection stability during use of the rocking chair, thereby avoiding looseness. Upper clearance slots 16 are formed in lower ends of the upper bases 1, and head portions of the upper fasteners 9 are hidden within the upper clearance slots 16. The structure can avoid interference or a hanging collision phenomenon caused by the exposure of the head portions of the fasteners and make the overall appearance more complete.

Figure 7:
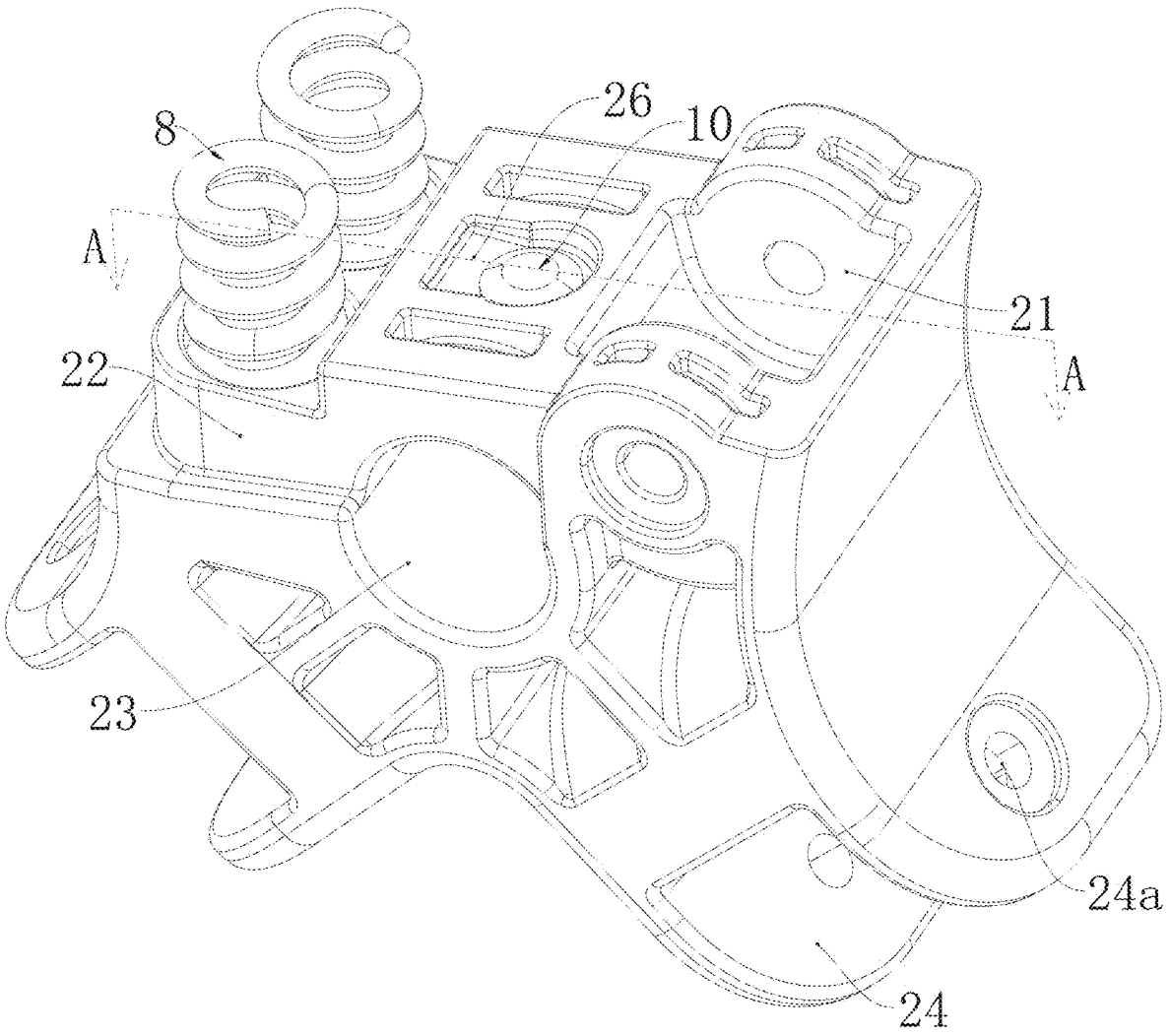
FIG. 7 is a perspective view of a lower base according to Embodiment I of the present disclosure.
Figure 8:
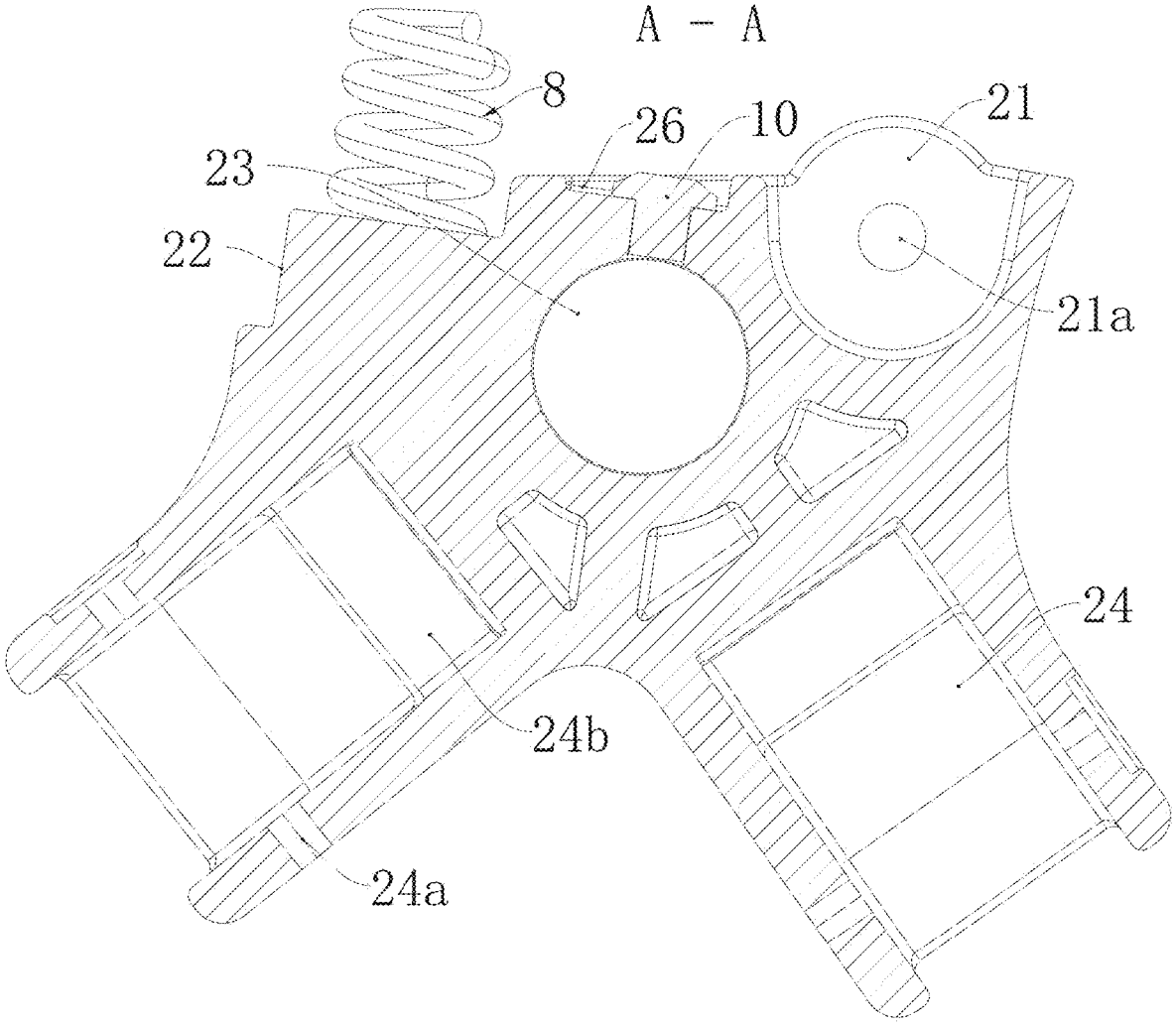
FIG. 8 is a vertical cross-sectional view of a lower base according to Embodiment I of the present disclosure.
Figure 14:
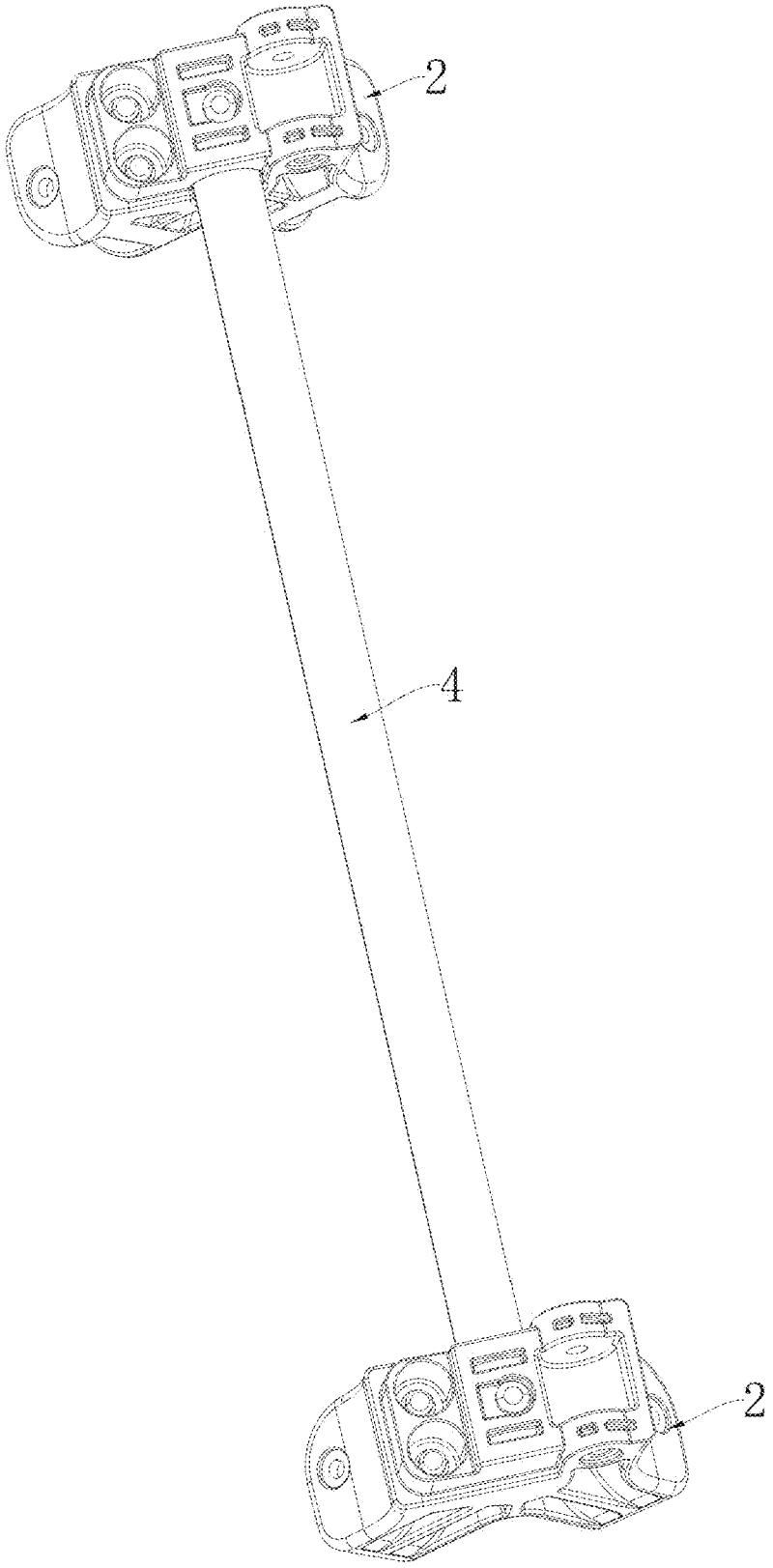
FIG. 14 is a schematic diagram of connection between a lower base and a lower connecting rod according to Embodiment I of the present disclosure.
Figure 15:
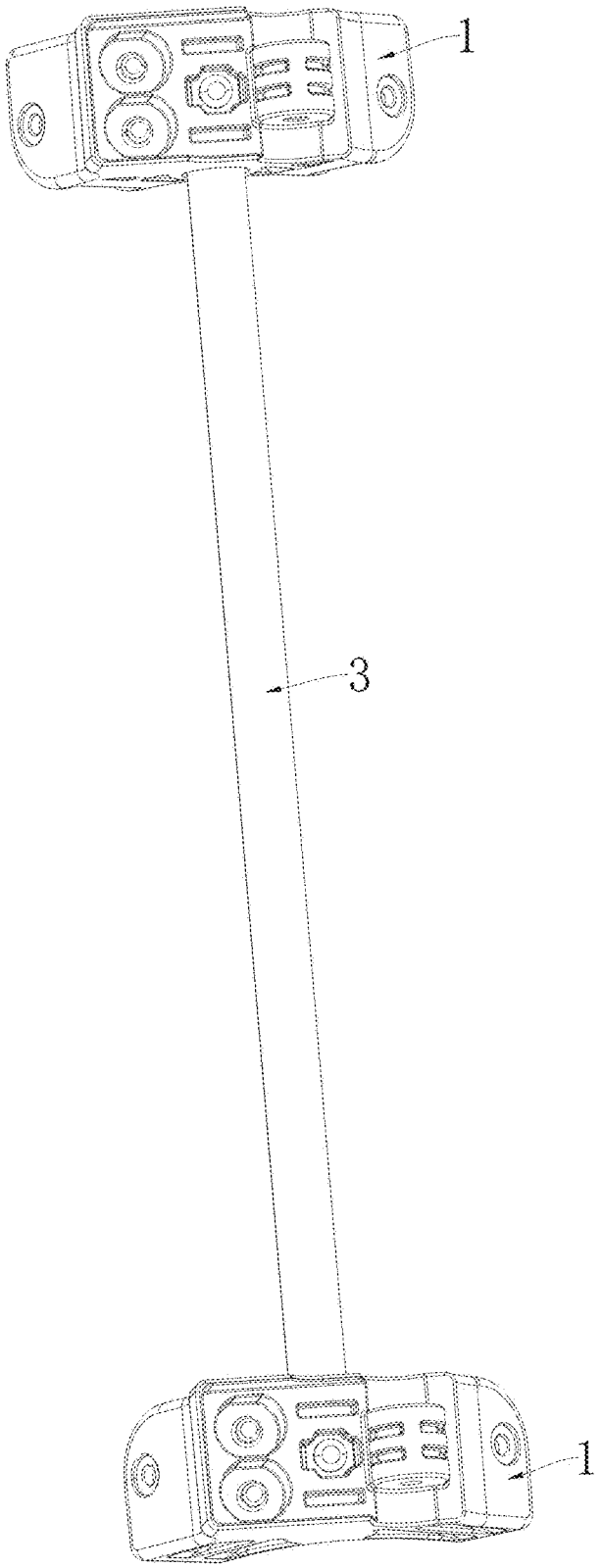
FIG. 15 is a schematic diagram of connection between an upper base and an upper connecting rod according to Embodiment I of the present disclosure.
Figure 16:
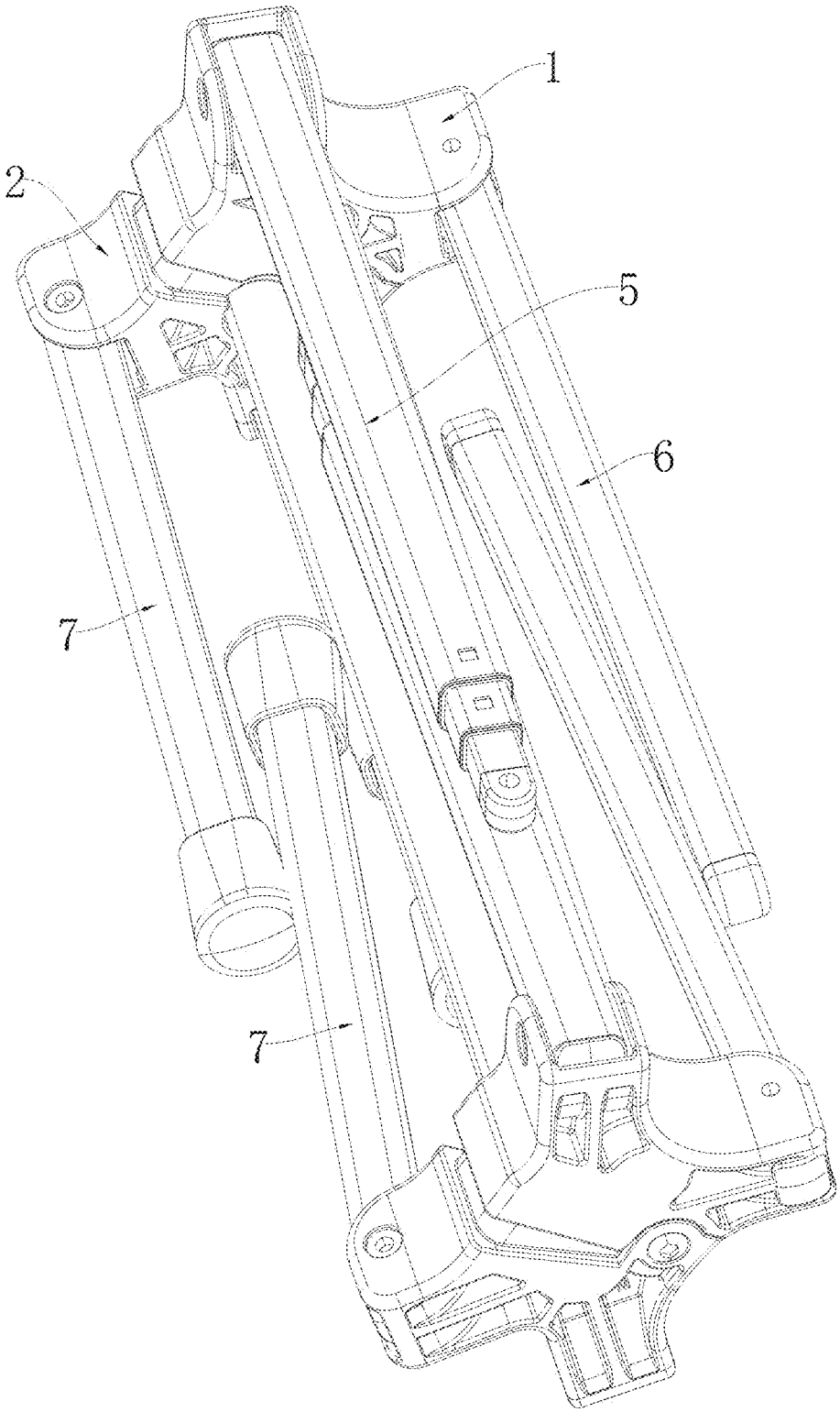
FIG. 16 is a perspective view of a chair frame in a folded state according to Embodiment I of the present disclosure.

Specifically, as shown in FIG. 7, FIG. 8, and FIG. 14, lower connection slots 23 are oppositely formed in inner sides of the two lower bases 2, and the lower connecting rod 4 is disposed within the lower connection slots 23 in a plugged manner, to form a lower stable transverse connection structure, so that when a force is applied to a bottom of the chair frame, the chair frame has a uniform force distribution. The lower bases 2 are provided with lower fasteners 10 in a connected manner. Inner ends of the lower fasteners 10 extend into the lower connection slots 23 and abut against plugged portions of the lower connecting rod 4. The lower connecting rod 4 can be compressed and fixed through the lower fasteners 10, so that a bottom structure is not loosened during rocking, thereby improving usage reliability of the entire structure. Lower clearance slots 26 are formed in lower ends of the lower bases 2, and head portions of the lower fasteners 10 are hidden in the lower clearance slots 26, to avoid interference caused by the exposure of the fasteners, thereby improving usage security and appearance integrity.

Figure 13:
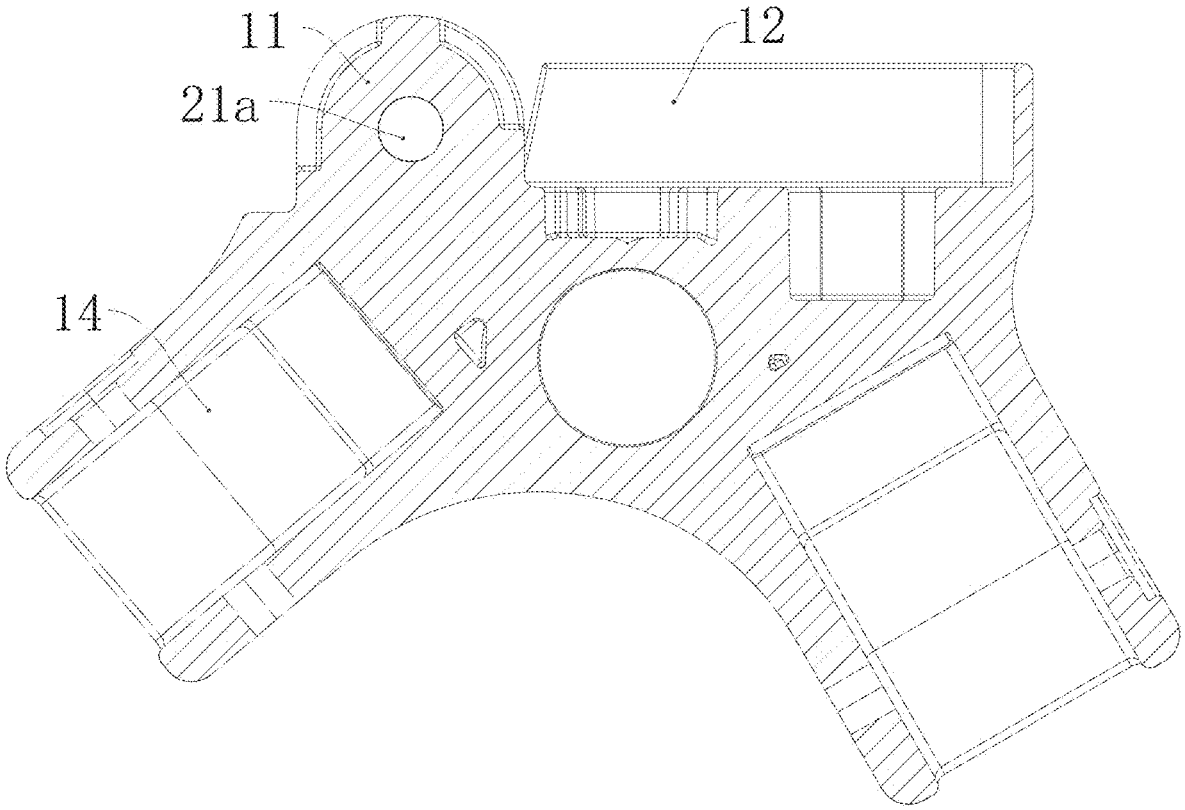
FIG. 13 is a vertical cross-sectional view of an upper base according to Embodiment I of the present disclosure.

Specifically, as shown in FIG. 12 and FIG. 13, each upper base 1 is provided with an upper open slot 14, and the supporting rod is hinged to the upper open slot 14. Each lower base 2 is provided with a lower open slot 24, and the supporting leg 7 is hinged to the lower open slot 24. A second shaft hole 24*a* is formed in a side wall of the lower open slot 24, and a rotating shaft 73 passes through corresponding positions of the second shaft hole 24*a* and the supporting leg 7, so that the supporting leg 7 can be rotated relative to the lower base 2.

Figure 9:
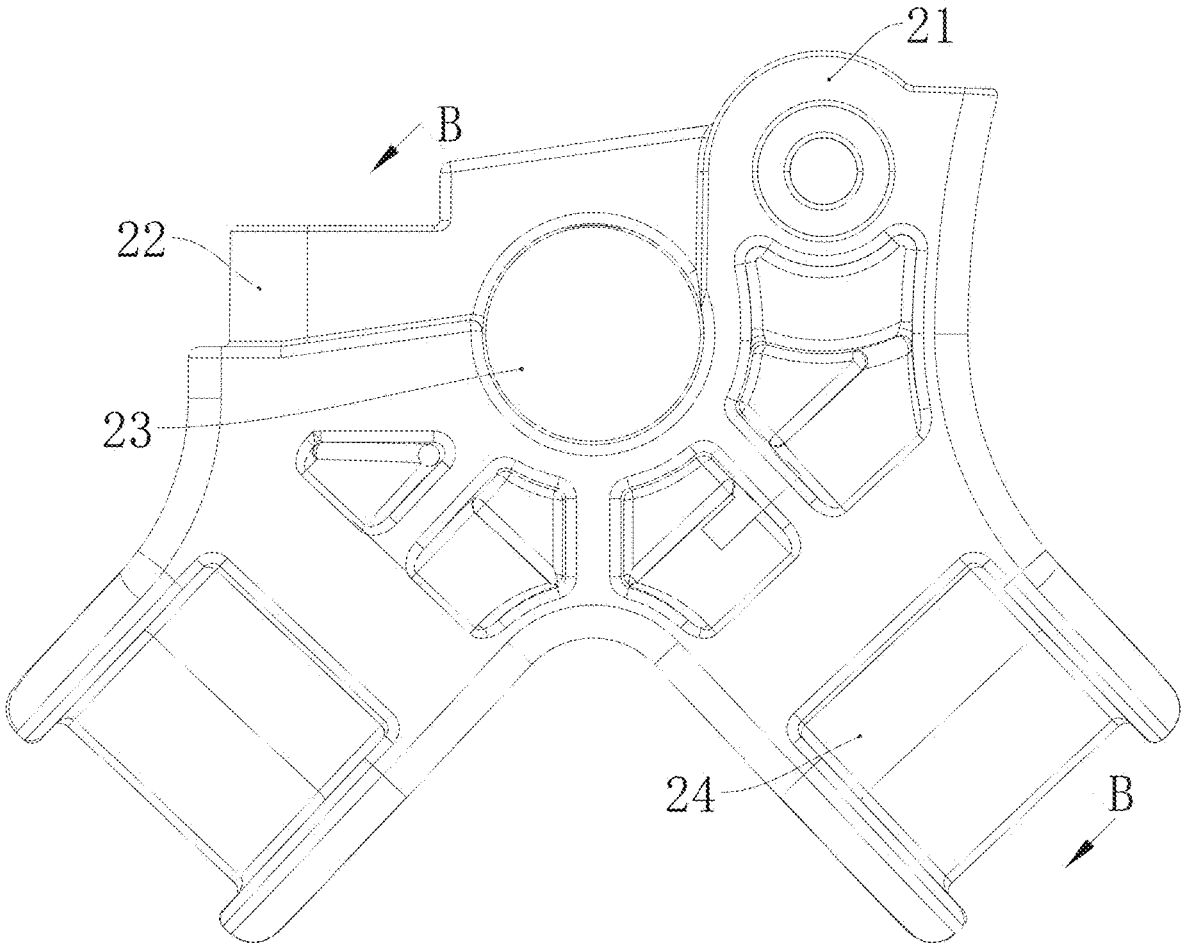
FIG. 9 is a side view of a lower base according to Embodiment I of the present disclosure.
Figure 10:
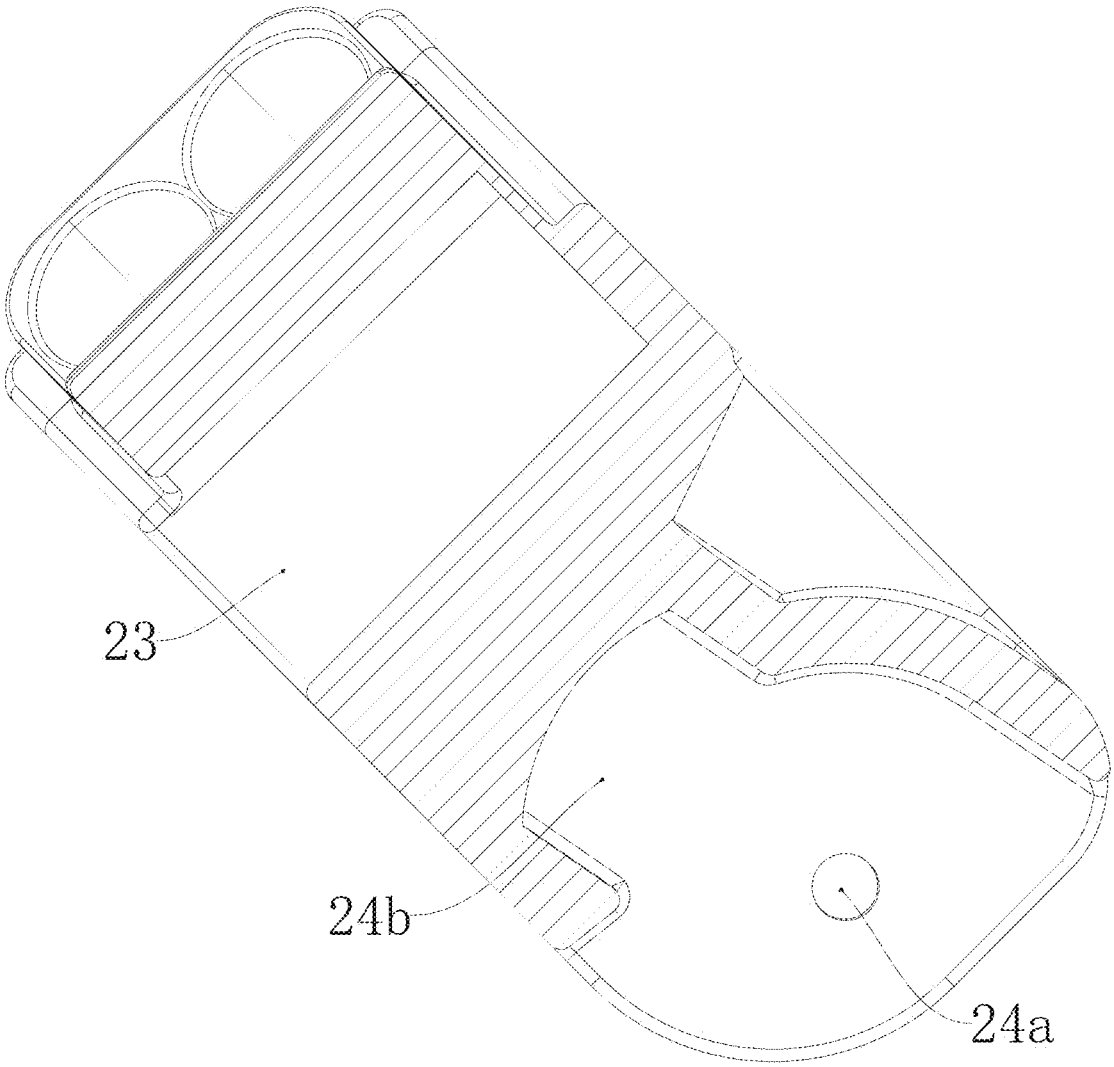
FIG. 10 is a cross-sectional view of line B-B in FIG. 9.

Further, as shown in FIG. 9 and FIG. 10, each lower base 2 is provided with a plugging slot 24*b*. The plugging slot 24*b* is located on a side wall of the lower open slot 24 in a recessed manner. When the supporting leg 7 is rotated to an unfolding position, an inner end of the supporting leg 7 slides inwards into the plugging slot 24*b*, thereby forming mechanical angle locking, so that the supporting leg 7 remains in an unfolded and upright state after being unfolded, thereby improving reliability of supporting of the chair frame.

Figure 17:
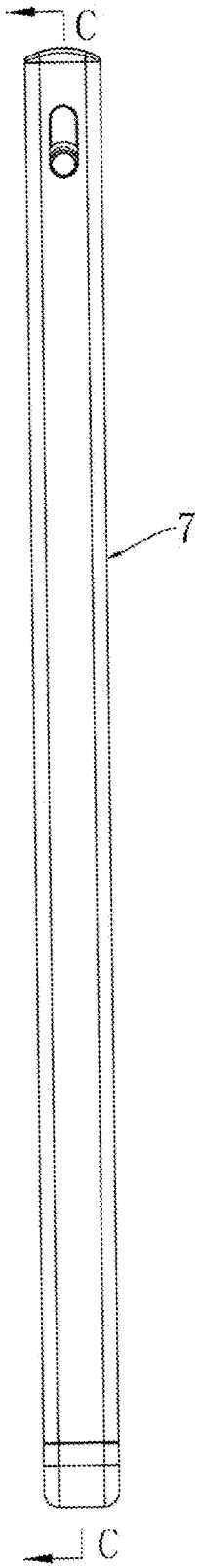
FIG. 17 is a schematic structural diagram of a supporting leg according to Embodiment I of the present disclosure.
Figure 18:
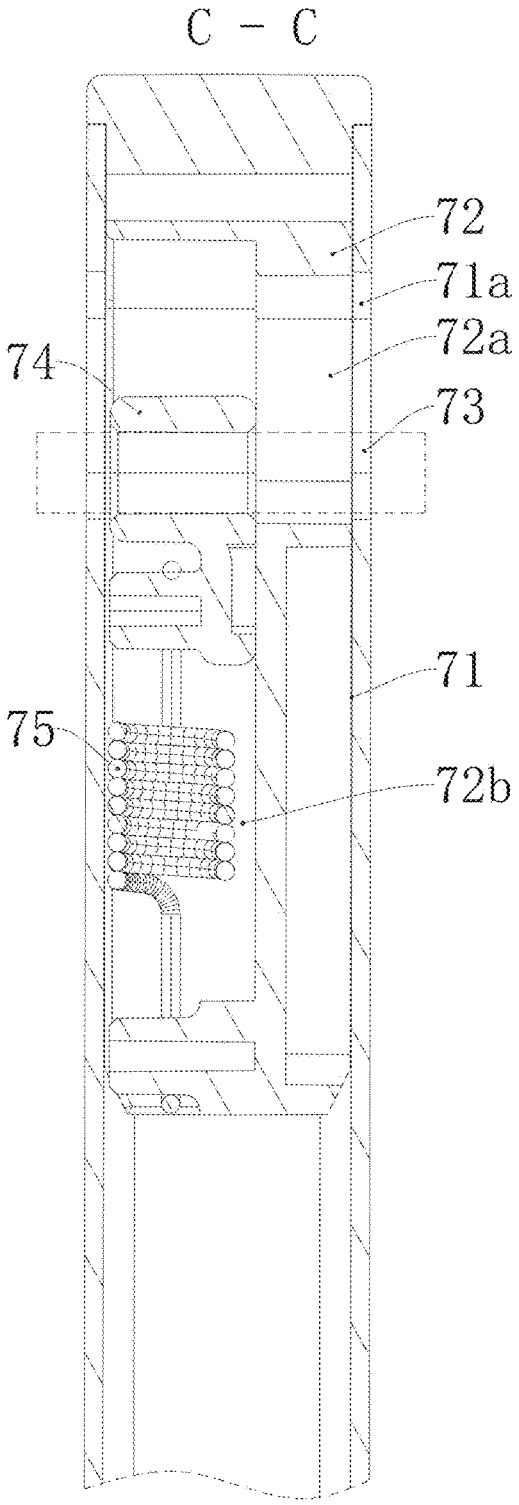
FIG. 18 is a sectional view of line C-C in FIG. 17.
Figure 19:
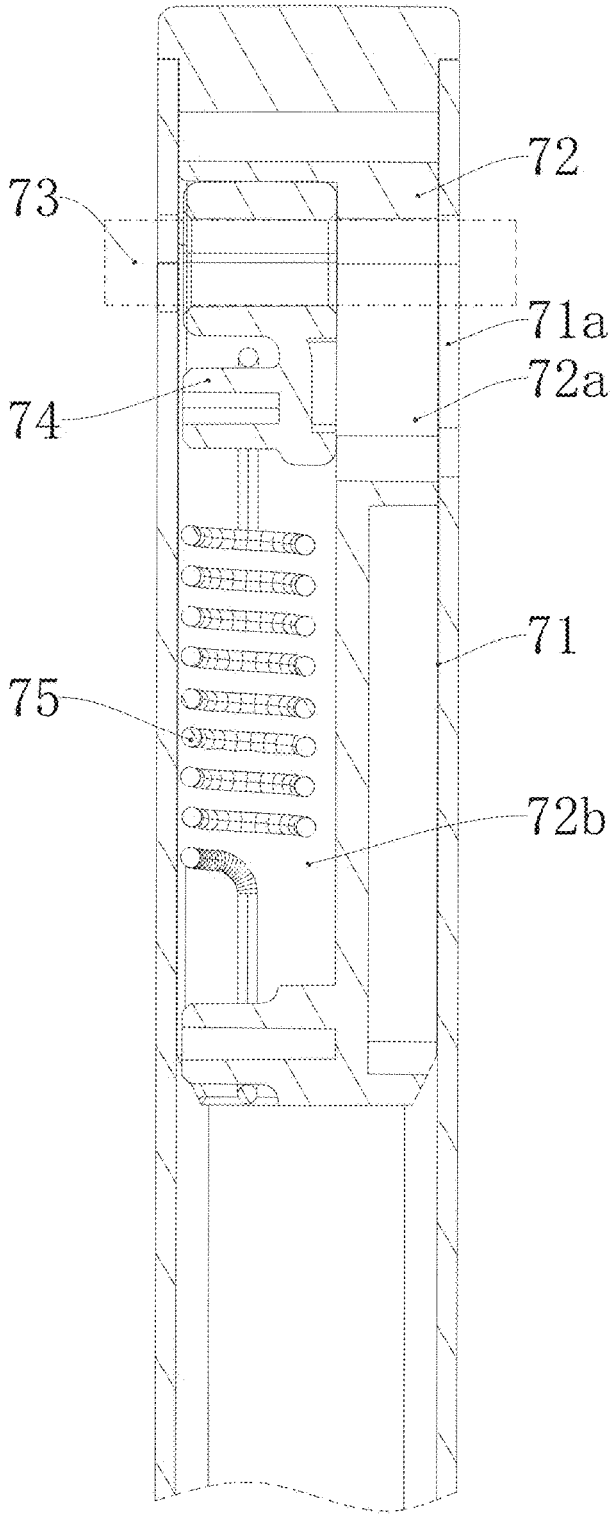
FIG. 19 is a cross-sectional view of a supporting leg being separated from a plugging slot according to Embodiment I of the present disclosure.

Still further, as shown in FIG. 17 to FIG. 19, the supporting leg 7 includes a rod body 71, a connector 72, and a shaft sleeve 74. The rod body 71 is a hollow metal tubular member, and a cross-sectional form of the rod body 71 may be selected based on a bearing requirement and structural deployment, and is preferably of a square tube or round tube structure. In this implementation, the rod body 71 is an aluminum alloy square tube, so as to ensure strength and stiffness while achieving overall weight reduction. The connector 72 is arranged at one end of the rod body 71, and is fixed inside the rod body 71 in a plugged manner. The connector 72 may be made of a metal material or a high-strength plastic material, and is configured to: implement hinge and guide fit between the supporting leg 7 and the lower base 2 and achieve force transferring and structural transitioning.

Further, as shown in FIG. 18 and FIG. 19, a first kidney-shaped hole 7*la* is formed in a side wall of the rod body 71 in a penetrating manner in a transverse direction. A second kidney-shaped hole 72*a* is correspondingly formed in a side wall of the connector 72 in a penetrating manner. The first kidney-shaped hole 71*a* and the second kidney-shaped hole 72*a* are aligned with each other in an assembled state, and are configured to provide a radial movement space for the rotating shaft 73. A sliding chute 72*b* is formed in one side of the connector 72 in a length direction. The sliding chute 72*b* guides and constrains a movement trajectory of the supporting leg 7. Through the rotating shaft 73, the supporting leg 7 is hinged to the lower open slot 24 formed in the lower base 2, so that the supporting leg 7 can rotate relative to the lower base 2.

Still further, as shown in FIG. 18, the rotating shaft 73 is threaded into the first kidney-shaped hole 71*a*, the shaft sleeve 74, and the second kidney-shaped hole 72*a* in sequence. The rotating shaft 73 has a slidable limiting fit relationship with the first kidney-shaped hole 71*a* and the second kidney-shaped hole 72*a*, so that the rotating shaft 73 can have a relative displacement in the length directions of the kidney-shaped holes. A rotatable fit relationship is formed between the rotating shaft 73 and the shaft sleeve 74, so as to ensure smoothness during the rotation of the supporting leg 7. In addition, a sliding fit relationship is formed between the shaft sleeve 74 and the sliding chute 72*b*, so that the shaft sleeve 74 moves in a given direction under the guide action of the sliding chute 72*b*. The shaft sleeve 74 is rotatably sleeved on an outer side of the rotating shaft 73, and is kept being axially fixed relative to the rotating shaft 73, thereby reducing friction and improving structural durability during the rotation.

Further, as shown in FIG. 19, a second spring 75 is disposed between the shaft sleeve 74 and the connector 72. The second spring 75 is configured to apply an elastic force to the connector 72 in a movement process of the supporting leg 7. The elastic force provided by the second spring 75 has a tendency of keeping the supporting leg 7 being plugged into the plugging slot 24*b*, thus improving stability and reliability of connection between the supporting leg 7 and the lower base 2.

Embodiment II

Figure 20:
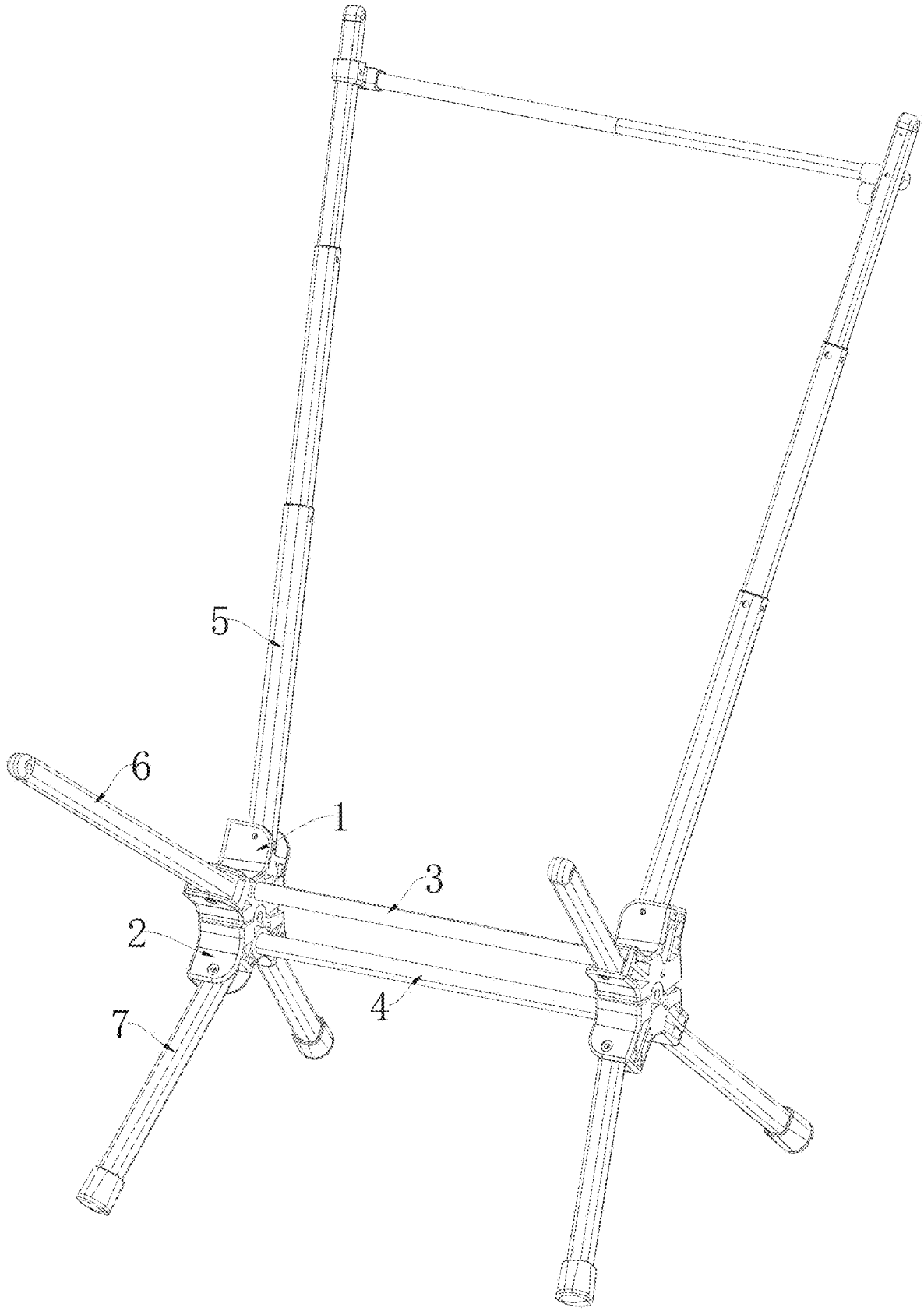
FIG. 20 is a perspective view of a rocking chair frame according to Embodiment II of the present disclosure.
Figure 21:
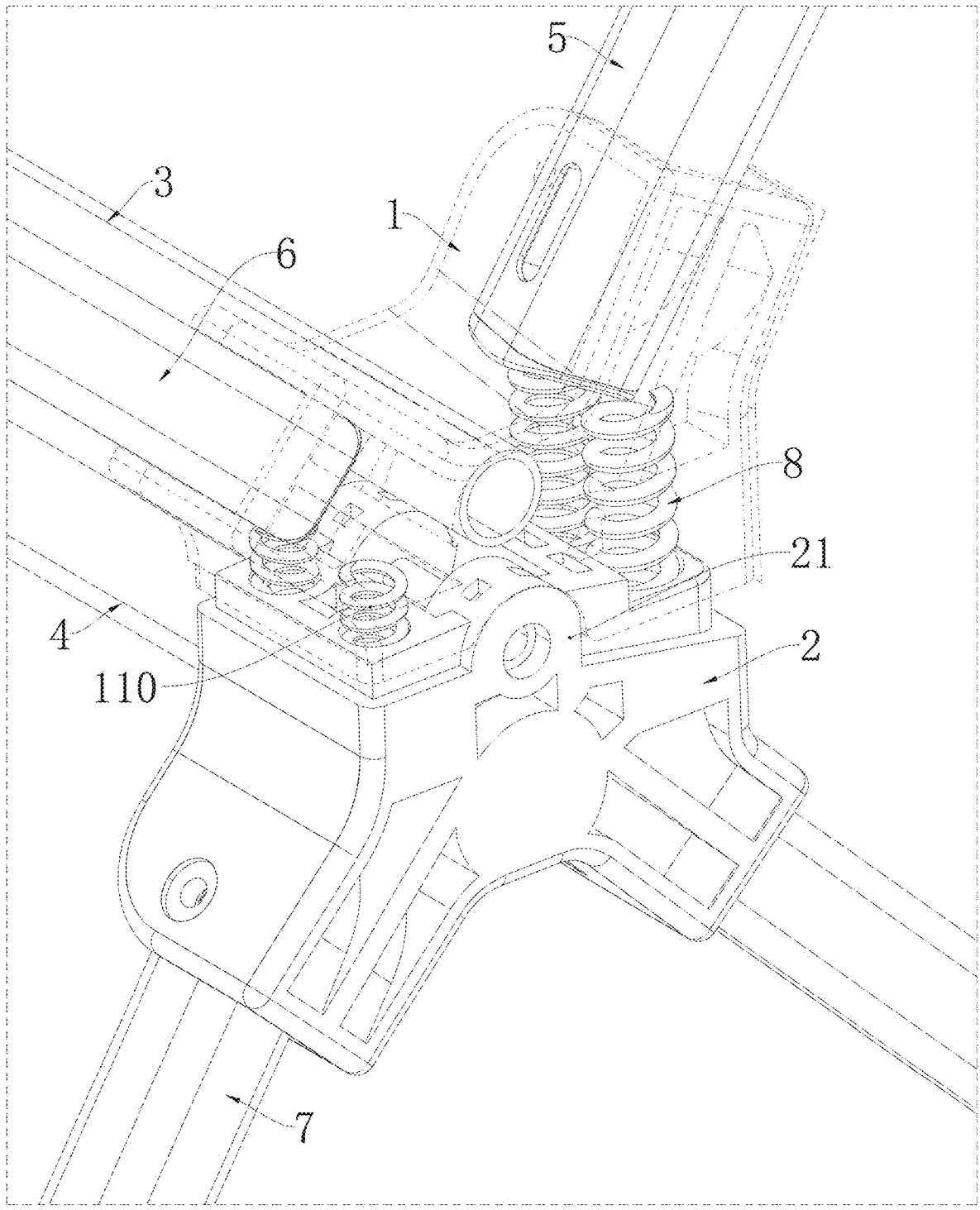
FIG. 21 is a partially enlarged view of a rocking chair frame according to Embodiment II of the present disclosure.

As shown in FIG. 20 and FIG. 21, the overall structure, the constituent parts, and the basic working principle of this embodiment are basically the same as those in Embodiment I, and a difference lies in that: in this embodiment, third springs 110 are added between the upper base 1 and the lower base 2, to further optimize buffering performance and use comfort of the chair frame during rocking.

Further, the upper base 1 and the lower base 2 implement relative rotatable connection through a hinge structure, and a hinged position is used as a main rotation center of a rocking motion of the chair frame. A pair of first springs 8 and a pair of third springs 110 are respectively arranged on front and rear sides of the hinged position. The first springs 8 and the third springs 110 are staggered in a front-rear direction of the chair frame, and are spatially located on two opposite sides of a hinged position.

Still further, one end of each third spring 110 is connected to the upper base 1, and another end of the third spring 110 is connected to the lower base 2, so that the third springs 110 undergo elastic deformation when the upper base 1 and the lower base 2 rotate relative to each other. When a rocking motion occurs in a forward direction of the chair frame, the upper base 1 has a tendency of forward tilting relative to the lower base 2. The third springs 110 first enter a stressed state, and the rocking process is buffered through the elastic deformation of the third springs 110, thereby effectively reducing an instantaneous impact load between the upper base 1 and the lower base 2.

Further, through the arrangement of the third springs 110, direct rigid collision between the front stop part 18 and the front blocking part 28 when the chair frame rocks forward to a limit position can be avoided, thereby reducing structural impact noise, reducing local stress concentration, and prolonging service lives of related connected portions. In addition, the third springs 110 cooperate with the first springs 8 located on the other side of the hinged position, so that a continuous and soft elastic damping effect can be achieved during the rocking of the chair frame in both front and rear directions.

Still further, the front-rear symmetrical or asymmetrical arrangement form of the first springs 8 and the third springs 110 can be adjusted based on different usage requirements, so that the chair frame presents different mechanical feedback characteristics during forward and backward rocking, thereby further improving comfort and stability of the rocking chair during use while ensuring structural safety.

In the descriptions of the present disclosure, it should be understood that orientations or positional relationships indicated by the technical terms "center", "longitudinal", "horizontal", "length", "width", "thickness", "upper", "lower", "front", "rear", "left", "right", "vertical", "horizontal", "top", "bottom", "inner", "clockwise", "anticlockwise", "axial", "radial", "circumferential", and the like are orientations or positional relationships as shown in the drawings, and are only for the purpose of facilitating and simplifying the descriptions of the present disclosure instead of indicating or implying that devices or elements indicated need to have particular orientations, and be constructed and operated in the particular orientations, so that these terms are not construed as limiting the present disclosure.

In the present disclosure, unless otherwise explicitly stipulated and restricted, that a first feature is "on" or "below" a second feature may include that the first and second features are in direct contact, or may include that the first and second features are in indirect contact using an intermediate. In addition, that the first feature is "on", "above", or "over" the second feature may include that the first feature is directly or diagonally above the second feature or merely indicates that a level of the first feature is higher than that of the second feature. The first feature "below", "beneath", and "under" of the second feature can indicate that the first feature is directly or diagonally below the second feature, or merely indicates that a level of the first feature is less than that of the second feature.

The embodiments of the present disclosure have been shown and described above, but it can be understood that the above embodiments are exemplary and cannot be understood as limitations on the present disclosure. A person of ordinary skill in the art may make changes, modifications, substitutions, and transformations to the above embodiments within the scope of the present disclosure.

What is claimed is:

1. A foldable rocking chair frame, comprising:

two upper bases and two lower bases, wherein the upper bases and the lower bases are arranged vertically and are hinged to each other to form two groups of hinged assemblies spaced apart from each other on left and right;

an upper connecting rod, wherein two ends of the upper connecting rod are respectively connected to the two upper bases; and a lower connecting rod, wherein two ends of the lower connecting rod are respectively connected to the two lower bases; and a plurality of first springs disposed between the upper base and the lower base of each group, wherein the first springs are arranged in a front-rear staggered manner relative to a hinged position of the upper base and the lower base;

each upper base is connected to one end of a supporting rod, and another end of the supporting rod is configured to be connected to chair cloth; and each lower base is connected to one supporting leg;

wherein upper connection slots are formed in opposite inner sides of the two upper bases, and the upper connecting rod is plugged into the upper connection slots;

wherein upper fasteners are connected to the upper bases, and inner ends of the upper fasteners extend into the upper connection slots and abut against plugged portions of the upper connecting rod; and wherein upper clearance slots are formed in lower ends of the upper bases, and head portions of the upper fasteners are disposed within the upper clearance slots.

2. The foldable rocking chair frame according to claim 1, wherein lower connection slots are formed in opposite inner sides of the two lower bases, and the lower connecting rod is plugged into the lower connection slots.

3. The foldable rocking chair frame according to claim 2, wherein lower fasteners are connected to the lower bases, and inner ends of the lower fasteners extend into the lower connection slots and abut against plugged portions of the lower connecting rod.

4. The foldable rocking chair frame according to claim 3, wherein lower clearance slots are formed in lower ends of the lower bases, and head portions of the lower fasteners are disposed within the lower clearance slots.

5. The foldable rocking chair frame according to claim 1, wherein each upper base is provided with an upper open slot, and the supporting rod is hinged to the upper open slot; and/or each lower base is provided with a lower open slot, and the supporting leg is hinged to the lower open slot.

6. The foldable rocking chair frame according to claim 1, wherein each lower base is provided with a plugging slot; when the supporting leg is rotated relative to the lower base to an unfolding position, an inner end of the supporting leg is slidably plugged into the plugging slot to lock an angle of the supporting leg; and/or the foldable rocking chair frame further comprises third springs disposed between the upper base and the lower base of each group; and the third springs and the first springs are respectively located on front and rear sides of the hinged position.

7. A rocking chair, comprising chair cloth and the foldable rocking chair frame according to claim 1.

* * * * *